US009718075B2

(12) United States Patent
Werkheiser et al.

(10) Patent No.: US 9,718,075 B2
(45) Date of Patent: Aug. 1, 2017

(54) SUSPENSION PLASMA INJECTOR SYSTEM AND METHOD OF FLUSHING THE SYSTEM

(71) Applicant: United Technologies Corporation, Hartford, CT (US)

(72) Inventors: William F. Werkheiser, East Hartford, CT (US); Brian T. Hazel, Avon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 14/734,059

(22) Filed: Jun. 9, 2015

(65) Prior Publication Data

US 2015/0360252 A1 Dec. 17, 2015

Related U.S. Application Data

(60) Provisional application No. 62/011,297, filed on Jun. 12, 2014.

(51) Int. Cl.

| | |
|---|---|
| ***B05B 15/02*** | (2006.01) |
| ***B05B 7/16*** | (2006.01) |
| ***B05B 7/22*** | (2006.01) |
| ***B08B 3/02*** | (2006.01) |
| ***B05B 3/04*** | (2006.01) |

(Continued)

(52) U.S. Cl.

CPC ..... *B05B 15/025* (2013.01); *B05B 7/1404* (2013.01); *B05B 7/1418* (2013.01); *B05B 7/1468* (2013.01); *B05B 7/1606* (2013.01); *B05B 7/205* (2013.01); *B05B 7/222* (2013.01); *B05B 7/226* (2013.01); *B05B 15/02* (2013.01); *B05B 15/0266* (2013.01); *B08B 3/02* (2013.01); *B08B 3/04* (2013.01); *C23C 4/00* (2013.01); *C23C 4/129* (2016.01); *C23C 4/134* (2016.01); *H05H 1/42* (2013.01); *B08B 9/0321* (2013.01); *Y10T 137/0419* (2015.04)

(58) Field of Classification Search

None

See application file for complete search history.

(56) References Cited

U.S. PATENT DOCUMENTS 4,291,640 A * 9/1981 Payne ..... B05B 5/12 118/308
4,500,038 A * 2/1985 De Ferrari ..... B05B 7/1404 239/127

(Continued)

FOREIGN PATENT DOCUMENTS

WO 2012082902 6/2012

OTHER PUBLICATIONS

Extended European Search Report for Application No. 151715852.8 mailed on Dec. 4, 2015.

*Primary Examiner* — Binu Thomas

(74) *Attorney, Agent, or Firm* — Carlson, Gaskey & Olds, P.C.

(57) ABSTRACT

A thermal sprayer system includes an injector conduit in communication with an injector and a first valve for selectively directing a coating fluid through the injector conduit. A flush fluid conduit is in communication with the injector conduit for directing a flush fluid through the injector conduit. A pressurized air conduit is in communication with the injector conduit for directing a pressurized fluid through the injector conduit.

15 Claims, 1 Drawing Sheet

(51) Int. Cl.

| | |
|---|---|
| ***C23C 4/12*** | (2016.01) |
| ***B08B 3/04*** | (2006.01) |
| ***B05B 7/20*** | (2006.01) |
| ***B05B 7/14*** | (2006.01) |
| ***C23C 4/129*** | (2016.01) |
| ***C23C 4/00*** | (2016.01) |
| ***H05H 1/42*** | (2006.01) |
| ***C23C 4/134*** | (2016.01) |
| *B08B 9/032* | (2006.01) |

(56) References Cited

U.S. PATENT DOCUMENTS

| | | | | |
|---|---|---|---|---|
| 5,934,566 | A | 8/1999 | Kanno et al. | |
| 6,916,502 | B2 | 7/2005 | Moore et al. | |
| 7,112,758 | B2 | 9/2006 | Ma et al. | |
| 2004/0226508 | A1 | 11/2004 | Ma et al. | |
| 2006/0278254 | A1 | 12/2006 | Jackson | |
| 2006/0289405 | A1 | 12/2006 | oberste-Berghaus et al. | |
| 2007/0084244 | A1 | 4/2007 | Rosenflanz et al. | |
| 2008/0072790 | A1 | 3/2008 | Ma et al. | |
| 2008/0090071 | A1 | 4/2008 | Valle et al. | |
| 2013/0270355 | A1* | 10/2013 | Cotler | B05B 7/226 239/106 |
| 2013/0284203 | A1 | 10/2013 | VanEvery | |

* cited by examiner

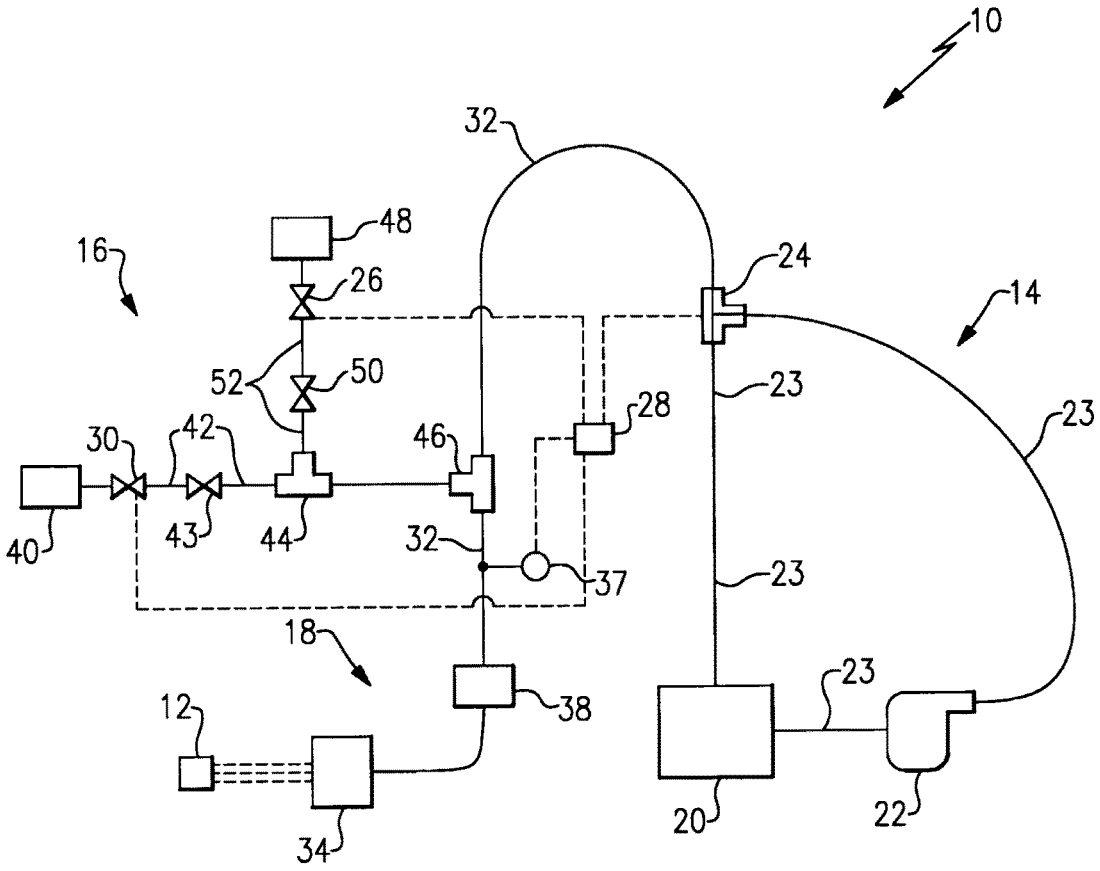
10
32
48
16
26
24
14
52
50
23
28
23
30
42
46
40
43
44
32
37
23
18
23
12
38
34
20
22

SUSPENSION PLASMA INJECTOR SYSTEM AND METHOD OF FLUSHING THE SYSTEM

CROSS-REFERENCE TO RELATED APPLICATIONS

This application claims priority to U.S. Provisional Application No. 62/011,297, which was filed on Jun. 12, 2014 and is incorporated herein by reference.

BACKGROUND

Thermal spray processes have been widely used in industrial applications for the deposition of coatings, including aerospace, motor vehicles, petroleum and petrochemical, bio-medicine. Plasma spray coatings adhere to a substrate primarily by mechanical forces. The plasma spray coatings are sprayed onto the substrate through the use of an injector that heats the suspension to a predetermined temperature to ensure it adheres to a component.

After operating of the thermal sprayer for an extended period of time, the plasma spray coating can begin to accumulate and harden in the injector. The accumulation and hardening of the plasma spray coating will eventually clog the injector and require the thermal sprayer to be shut down in order to install a new injector. Therefore, there is a need for a thermal sprayer with an injector that extends the usable period of operation of the thermal sprayer without clogging or obstructing the injector.

SUMMARY

In one exemplary embodiment, a thermal sprayer system includes an injector conduit in communication with an injector and a first valve for selectively directing a coating fluid through the injector conduit. A flush fluid conduit is in communication with the injector conduit for directing a flush fluid through the injector conduit. A pressurized air conduit is in communication with the injector conduit for directing a pressurized fluid through the injector conduit.

In a further embodiment of the above, includes is a pressure sensor for monitoring a fluid pressure in the injector conduit.

In a further embodiment of any of the above, there is a vent for venting the coating fluid when a pressure in the injector conduit exceeds a predetermined operating level pressure.

In a further embodiment of any of the above, the coating fluid is a zirconia ceramic particulate suspended in ethanol.

In a further embodiment of any of the above, a circulation loop is located upstream of the first valve for circulating the coating fluid.

In a further embodiment of any of the above, the circulation loop includes a second valve for selectively directing the coating fluid to at least one of a reservoir or the injector conduit.

In a further embodiment of any of the above, the circulation loop includes a pump for pumping the coating fluid.

In a further embodiment of any of the above, the circulation loop includes a gas pressure source for driving the coating fluid.

In a further embodiment of any of the above, the flush fluid is water.

In another exemplary embodiment, a method of flushing a plasma sprayer includes sensing an increase in pressure in an injector conduit in fluid communication with an injector that exceeds a predetermined operating level pressure, flushing the injector conduit and the injector with a flush fluid and flushing the injector conduit and the injector with a pressurized fluid.

In a further embodiment of the above, the method includes isolating a coating fluid reservoir from the injector conduit by moving a three-way valve to a first position.

In a further embodiment of any of the above, the method includes spraying the coating fluid through the injector by moving the three-way valve to a second position.

In a further embodiment of any of the above, the method includes flushing the injector conduit and the injector with the flush fluid a second time after flushing the injector conduit and the injector with the pressurized fluid.

In a further embodiment of any of the above, the method includes flushing the injector conduit and the injector with the pressurized fluid a second time after flushing the injector conduit and the injector with the flush fluid the second time.

In a further embodiment of any of the above, the increase in pressure of the coating fluid in the injector conduit that exceeds the predetermined operating level pressure indicates a partial clog in at least one of the injector conduit and the injector.

In a further embodiment of any of the above, the method includes filling the injector conduit with the flush fluid after flushing the injector conduit and the injector with the pressurized fluid.

In a further embodiment of any of the above, the method includes venting the coating fluid when the pressure in the injector conduit exceeds the normal operating level.

BRIEF DESCRIPTION OF THE DRAWINGS

The FIGURE shows a schematic of an example suspension plasma injector system with a flush system.

DETAILED DESCRIPTION

The FIGURE shows an example suspension plasma injector system 10. The injector system 10 is used to spray a coating fluid on a component 12. In one example, the injector system 10 may be used with a thermal spraying method, such as plasma spray, flame spray, or HVOF. The component 12 will generally be an element that is subjected to extreme temperatures during operation, such as combustor section components or turbine section components of a gas turbine engine. In one example, the coating fluid is a zirconia ceramic having a particle size of less than five microns suspended in an ethanol fluid that provides a thermal barrier on the component 12 to withstand exposure to extreme temperatures during use.

In one example embodiment, the injector system 10 may include a circulation loop 14, a flush system 16, and a spray system 18. The circulation loop 14 includes a reservoir 20 for storing the coating fluid and a pump 22 or gas pressure source for pumping the coating fluid through a circulation loop conduit 23 towards the spray system 18. The circulation loop 14 connects to the spray system 18 with a three-way valve 24.

The coating fluid circulates in the circulation loop 14 without entering the spray system 18 when the three-way valve 24 is moved to a first position such that the coating fluid is able to flow freely back into the reservoir 20 through the circulation loop conduit 23. In one example, the three-way valve 24 is a pneumatically actuated valve and in another example, the three-way valve 24 is mechanically actuated.

The coating fluid enters the spray system 18 through the three-way valve 24 when the three-way valve 24 is in a second position to allow coating fluid to enter an injector conduit 32.

The spray system 18 includes the injector conduit 32 fluidly connected to the three-way valve 24 so that the spray system 18 is in fluid communication with the coating fluid in the reservoir 20 in the circulation loop 14. If a pressure of the coating fluid traveling through the injector conduit 32 exceeds a predetermined maximum pressure level, a vent 38 can release the excess pressure in the injector conduit 32 before the injector system 10 is damaged. In one example, the predetermined operating pressure level is approximately 100 psi.

When the pressure in the injector conduit 32 measured by a pressure sensor 37 exceeds a predetermined operating pressure level, the pressure sensor sends a signal to a controller 28 to move the three-way valve 24 to the first position so the coating fluid can circulate in the circulation loop 14 without entering the injector conduit 32. In one example, the predetermined operating pressure level is between 25 psi and 55 psi. An increase in pressure above the predetermined operating pressure level usually indicates the presence of an accumulation of coating ceramic material in an injector 34. After an increase in pressure above the predetermined operating pressure level is measured, the injector 34 is flushed with the flush system 16 to clear an accumulation of coating fluid from the injector 34 and allow the injector system 10 to operate properly again. Additionally, the injector 34 may be flushed periodically even before the increase in pressure above the predetermined operating pressure level is measured in order to keep the coating fluid flowing through the injector 34 freely.

Before the injector 34 and the injector conduit 32 can be flushed, a user must confirm that the coating fluid circulating in the circulation loop 14 is isolated from the flush system 16 so that the coating fluid is not contaminated by the flush system 16. In order to isolate the flush system 16 from the coating fluid in the circulation loop 14, the controller 28 moves the three-way valve 24 into the first position. This allows the coating fluid to circulate through the circulation loop conduit 23 connecting the reservoir 20, the pump 22, and the three-way valve 24. The coating fluid is not allowed to pass beyond the three-way valve 24 when flushing the injector system 10 with the flush system 16.

The controller 28 moves the three-way valve 24 to the first position and opens a flushing fluid valve 30 to allow a flushing fluid, such as water, to flow from a flushing fluid source 40 through a flushing fluid conduit 42. The flushing fluid conduit 42 includes a check valve 43 upstream of a flush system tee 44 that is in fluid communication with an injector conduit tee 46. The flushing fluid then travels through the injector conduit 32 and out of the injector 34. The flushing fluid is not allowed to travel in the circulation fluid conduit 23.

After the flush fluid has passed through the injector conduit 32, the controller 28 then closes the flushing fluid valve 30 and opens pressured air source valve 26 to allow air to flow from a pressurized air source 48 through a pressurized air conduit 52. The pressurized air conduit 52 includes a check valve 50 upstream of the flush system tee 44 that is in fluid communication with the injector conduit tee 46. The air then travels through the injector conduit 32 and out of the injector 34. The pressurized air is not allowed to travel in the circulation fluid conduit 23.

The check valve 43 prevents air from traveling into the flushing fluid source 40 when flushing the spray system 18 with the pressurized air source 48. The check valve 50 prevents flushing fluid from traveling into the pressurized air source 48 when flushing the spray system 18 with the flushing fluid source 40. The check valves 43 and 50 also prevent coating fluid from entering the flushing fluid source 40 and the pressurized air source 48, respectively, when the coating fluid is flowing through the injector conduit 32.

The injector system 10 operates by spraying a coating fluid through the injector 34 onto the component 12 with the three-way valve 24 in the second position. When the pressure sensor 37 sends a signal to the controller that the predetermined operating pressure level has been exceeded, the injector 34 needs to be flushed. Additionally, the injector 34 can be flushed if it has been operated beyond a predetermined length of time. To flush the injector 34, the controller 28 isolates the coating fluid from the flush system 16 and the spray system 18 by moving the three-way valve 24 into the first position.

The spray system 18 is then flushed with the flush system 16. Once the injector 34 and the injector conduit 32 have been flushed with the flushing fluid, air from the pressurized air source 48 travels through the injector conduit 32 and the injector 34. The process of flushing the injector conduit 32 and the injector 34 with the flushing fluid followed by air can be performed at least one additional time to clear any partial clogs in the injector conduit 32 and the injector 34.

After the injector conduit 32 and the injector 34 have been flushed with air for the last time, the injector conduit 32 is filled with flushing fluid prior to coating fluid entering the injector conduit 32 downstream of the three-way valve 24. By filling the injector conduit 32 and the injector 34 with the flushing fluid prior to pumping coating fluid through the spray system 18, a fairly constant back pressure is measured by the pressure sensor 37. This prevents false alarms caused by excess pressurized coating fluid entering the injector conduit 32 upon startup based on a low pressure reading by the pressure sensor 37. Excess pressurized coating fluid entering the injector conduit 32 upon start up could exceed the predetermined maximum pressure level measured by the pressure sensor 37 and immediately shut off the injector system 10 because excess pressure could indicate that the injector 34 is partially clogged.

The flushing process described above allows the injector 34 to operate for longer periods of time and reduces the cost of replacing a clogged injector 34 as well as production losses that result from the downtime needed to replace the injector 34 in the injector system 10.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A thermal sprayer system comprising:

an injector conduit in communication with an injector;

a first valve for selectively directing a coating fluid through the injector conduit, wherein the first valve is located downstream of a reservoir for storing the coating fluid;

a flush fluid conduit in communication with the injector conduit for directing a flush fluid through the injector conduit;

a pressurized air conduit in communication with the injector conduit for directing a pressurized fluid through the injector conduit; and a pressure sensor for monitoring a fluid pressure in the injector conduit, wherein the pressure sensor is configured to monitor a pressure of the injector conduit at a location of the injector conduit downstream of the first valve, the flush fluid conduit, and the pressurized air conduit.

2. The system of claim 1, further comprising a vent for venting the coating fluid when a pressure in the injector conduit exceeds a predetermined operating level pressure.

3. The system of claim 1, wherein the coating fluid is a zirconia ceramic particulate suspended in ethanol.

4. The system of claim 1, further comprising a circulation loop located upstream of the first valve for circulating the coating fluid when the first valve is in a first position.

5. The system of claim 4, wherein the first valve selectively directs the coating fluid to the reservoir in the first position and to the injector conduit when in a second position.

6. The system of claim 5, wherein the circulation loop includes a pump for pumping the coating fluid.

7. The system of claim 6, wherein the circulation loop includes a gas pressure source for driving the coating fluid.

8. The system of claim 1, wherein the flush fluid is water.

9. The system of claim 1, wherein the first valve includes a first outlet upstream of the reservoir.

10. The system of claim 9, wherein the first valve includes a second outlet downstream of the reservoir.

11. The system of claim 1, wherein the first valve is a three-way valve.

12. The system of claim 1, including an injector conduit tee located upstream of the location of the pressure sensor monitoring a pressure of the injector conduit.

13. The system of claim 12, including a flush system tee upstream of the injector conduit tee.

14. The system of claim 4, wherein the circulation loop includes a fluid path connecting an outlet of the reservoir to an inlet of a pump, an outlet of the pump to the first valve, and an outlet of the first valve to the reservoir.

15. The system of claim 6, wherein the pump is downstream of the reservoir.

* * * * *